US007093305B2

(12) United States Patent
Reilly et al.

(10) Patent No.: US 7,093,305 B2
(45) **Date of Patent: *Aug. 22, 2006**

(54) PROTECTIVE HELMET WITH CARD DISPLAYING OR RECORDING DATA UNIQUE TO AUTHORIZED WEARER AND READABLE THROUGH HELMET POCKET WINDOW

(75) Inventors: John J. Reilly, Bayside, NY (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 122 days.

This patent is subject to a terminal disclaimer.

(21) Appl. No.: 10/609,833

(22) Filed: Jun. 27, 2003

(65) Prior Publication Data

US 2004/0261159 A1 Dec. 30, 2004

(51) Int. Cl.
*A42B 1/24* (2006.01)

(52) U.S. Cl. ..... 2/209.13

(58) Field of Classification Search ..... 2/209.13; 40/329

See application file for complete search history.

(56) References Cited

U.S. PATENT DOCUMENTS 3,829,995 A * 8/1974 Fakoury ..... 40/649
4,451,935 A * 6/1984 Henschel ..... 2/209.13
4,924,613 A 5/1990 Levin
5,195,123 A 3/1993 Clement
5,379,461 A 1/1995 Wilmers
5,452,479 A * 9/1995 Mostert ..... 2/195.1
5,548,847 A * 8/1996 Spicijaric ..... 2/209.13
5,572,741 A 11/1996 Bowman
5,596,652 A 1/1997 Piatek et al.
5,632,044 A 5/1997 Sloot
5,692,237 A 12/1997 Bennett
5,884,338 A 3/1999 Golde
5,915,539 A * 6/1999 Lack ..... 2/422
6,029,889 A 2/2000 Whalen, Jr. et al.
6,170,087 B1 * 1/2001 Brannon ..... 2/209.13
6,519,779 B1 * 2/2003 Taguchi ..... 2/209.12
6,643,967 B1 11/2003 Bloom
6,729,058 B1 * 5/2004 Ferguson ..... 40/636
6,751,805 B1 * 6/2004 Austion ..... 2/94
6,810,529 B1 * 11/2004 Reilly et al. ..... 2/69

* cited by examiner

*Primary Examiner*—Katherine M. Moran
(74) *Attorney, Agent, or Firm*—Wood, Phillips, Katz, Clark & Mortimer

(57) ABSTRACT

A protective helmet, which is intended to be only worn by a wearer who is authorized to pass through a security perimeter, comprises an outer shell, a pocket, which is mounted to the outer shell and which defines a window, a flap, which is movable between a position wherein the flap covers the window and positions wherein the flap does not cover the window, and a card, which is disposed in the pocket. The card displays or records data, which are readable through the window by a human, by an electronic reader, or by both, and which are unique to the authorized wearer of the protective garment. The data may comprise symbolic data, such as bar code data, and may comprise a photograph of the authorized wearer of the protective garment. When the flap covers the window, the flap protects the data against becoming unreadable because of foreign matter, such as soot, or because of surface abrasion.

7 Claims, 1 Drawing Sheet

PROTECTIVE HELMET WITH CARD DISPLAYING OR RECORDING DATA UNIQUE TO AUTHORIZED WEARER AND READABLE THROUGH HELMET POCKET WINDOW

TECHNICAL FIELD OF THE INVENTION

This invention pertains to a protective helmet, which is intended to be worn by a wearer, such as a firefighter, an emergency worker, a police officer, or a military person, who is authorized to pass through a security perimeter. This invention contemplates that the protective helmet comprises a card, which is disposed in a pocket defining a window and which displays or records data readable through the window and unique to the authorized wearer.

BACKGROUND OF THE INVENTION

Commonly, a firefighter carries an identifying card, which may display bar code data identifying the firefighter and which may display a photograph of the firefighter. As exemplified in U.S. Pat. No. 5,596,652 and U.S. Pat. No. 6,029,889, the disclosures of which are incorporated herein by reference, it is known for said data to be electronically scanned and to be then used to track firefighters arriving at a firefighting site, entering the firefighting site, and leaving the firefighting site.

As a matter of related interest, U.S. Pat. No. 5,572,741 discloses, on a firefighter's garment, a label bearing warnings, washing information, or other information. As stitched in place, the label is covered by a transparent, protective layer of a heat resistant, abrasion resistant, substantially waterproof material, which is stitched in place, all the way around the label. The material may be a biaxially oriented, copolymer film, such as KAPTON film manufactured by E.I. DuPont de Nemours and Company of Wilmington, Del.

Historically, perimeter security has been needed at military bases and other military sites. Terrorist activities on Sep. 11, 2001, in the United States and other incidents have highlighted that perimeter security may be also needed at firefighting sites and other sites, particularly where numerous firefighters, emergency workers, and police officers are gathered, many of whom may not be personally acquainted with one another.

SUMMARY OF THE INVENTION

This invention provides a protective helmet, which is intended to be only worn by a wearer who is authorized to pass through a security perimeter. The protective helmet comprises an outer shell, and a pocket, which is mounted to the outer shell and which defines a window. Preferably, the protective helmet further comprises a flap, which is movable between a position wherein the flap covers the window and positions wherein the flap does not cover the window. Preferably, the protective garment further comprises means, such as a hook-and-loop fastener, for attaching the flap detachably in the position wherein the flap covers the window.

This invention contemplates that the protective garment further comprises a card, which is disposed in the pocket. The card displays or records data, which are readable through the window by a human, by an electronic reader, or by both, and which are unique to the authorized wearer of the protective garment. The data may comprise symbolic date, such as bar code data, which identifies the authorized wearer, and a photograph of the authorized wearer of the protective garment.

As read by an electronic reader, the data may be used for perimeter security, by being compared to a database of authorized wearers, via a computer receiving the data from the electronic reader. Additionally, the same data may be used for any similar or dissimilar purpose disclosed in U.S. Pat. No. 5,596,652 and No. 6,029,889, supra. When the flap covers the window, the flap protects the data against becoming unreadable because of foreign matter, such as soot, or because of surface abrasion.

DETAILED DESCRIPTION OF THE ILLUSTRATED EMBODIMENT

Figure 1:
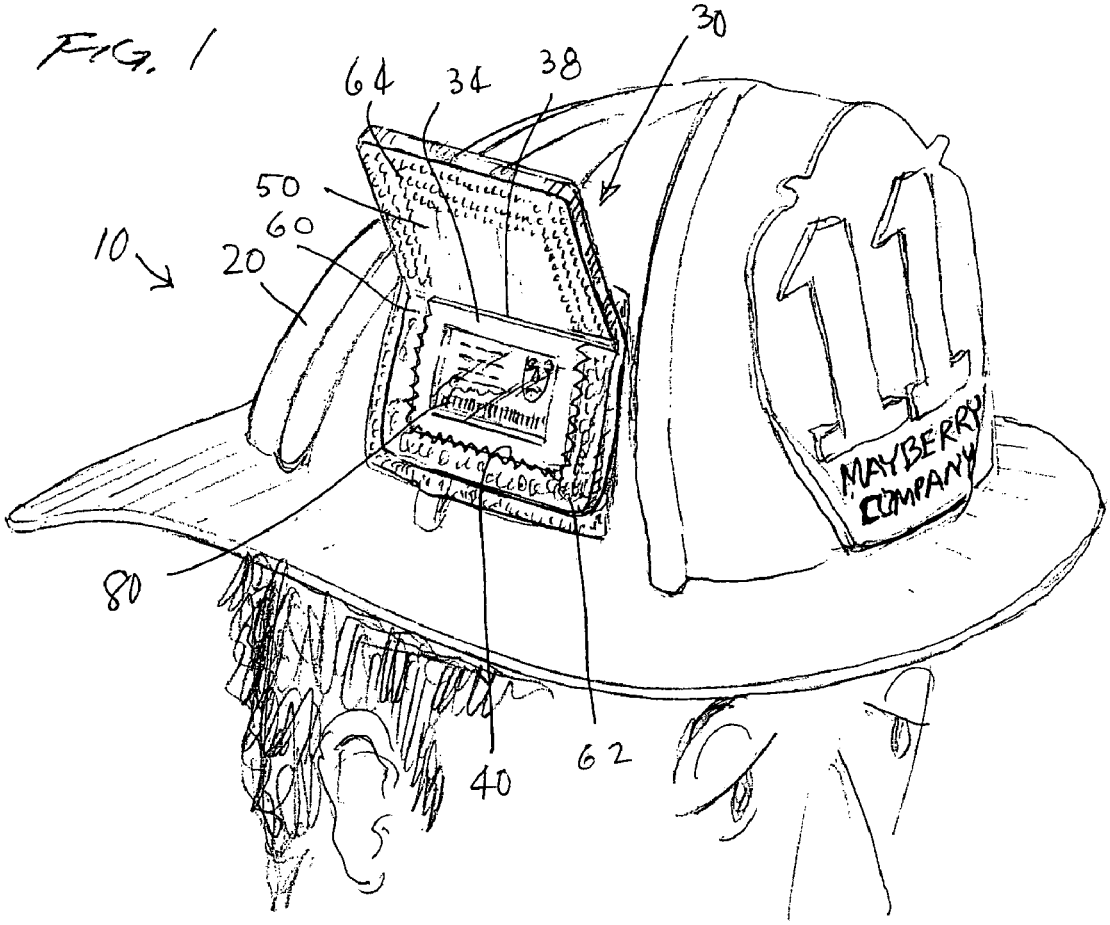
FIG. 1 is a fragmentary, perspective view of a protective helmet embodying this invention, comprising an outer shell, a pocket, which is mounted to the outer shell, which defines a window, and in which a card is disposed so that data displayed by the card are visible through the window, and a flap, which is movable between a position wherein the flap covers the window and positions wherein the flap does not cover the window.
Figure 2:
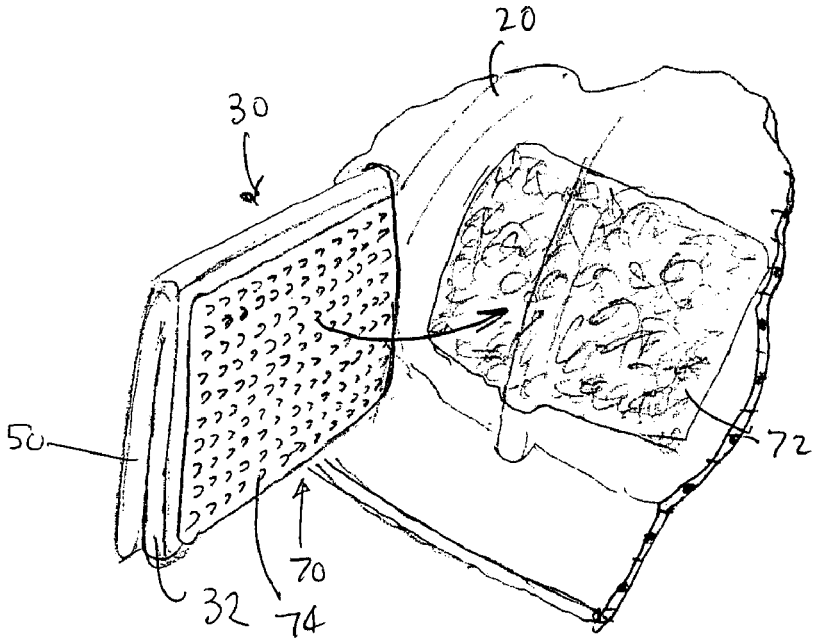
FIG. 2 is a fragmentary, perspective, exploded detail illustrating how the pocket is mounted to the outer shell.

As illustrated, a protective helmet 10 for a firefighter comprises an outer shell 20, a generally rectangular pocket 30, which defines a generally rectangular window 40 and which is provided by an inner, fabric panel 32 mounted to the outer layer shell 20 and by an outer, fabric panel 34 joined to the inner, fabric panel along the bottom and lateral margins of the outer, fabric panel 34 but not along the top margin 38 of the outer, fabric panel 34, and a generally rectangular flap 50, which is unitary with the inner, fabric panel 32 and which is foldable over the outer, fabric panel 34, above the top margin 38 of the fabric panel 32. The fabric panels 32, 34, are made from any fabric used heretofore for outer layers of outer shells of protective garments for firefighters.

Because the outer, fabric panel 34 is not sewn to the inner, fabric panel 32 along the top margin 38, the top margin 38 of the outer, fabric panel 34 remains detached from the inner, fabric panel 32. The flap 50 is movable, i.e., foldable, between a window-covering position wherein the flap 50 overlies the top, bottom, and lateral margins of the outer, fabric panel 34, so as to cover the window 40, and other positions wherein the flap 50 does not cover the window 40. The flap 50 is illustrated in one of the positions wherein the flap 50 does not cover the window 40.

As illustrated, a hook-and-loop fastener 60 is provided for attaching the flap 50 detachably in the window-covering position. The hook-and-loop fastener 60 comprises loop-faced tapes 62, which are sewn to the outer, fabric panel 34 along its bottom and lateral margins, and hook-faced tapes 64, which are sewn to the flap 60 along the flap margins that overlie the bottom and lateral margins of the outer, fabric panel 34 when the flap 50 is in the window-covering position. Other detachable attaching means, such as a mechanical zipper or a series of snap fasteners, may be alternatively provided for attaching the flap 50 detachably in the window-covering position.

As illustrated, a hook-and-loop fastener 70 is provided for attaching the pocket 30 detachably to the outer shell 22. The hook-and-loop fastener 70 comprises a loop-faced panel 72, which is mounted to the outer shell 22 via a suitable adhesive, and a hook-faced panel 74, which is mounted to the inner, fabric panel 32, on the posterior surface of the inner, fabric panel 32, via stitches, a suitable adhesive, or both.

As illustrated, a card 80 displays, on its anterior surface, alphanumeric data, which includes the name, departmental rank, and departmental affiliation of an authorized wearer of the protective garment 10, symbolic data, such as bar code data, which identify the authorized wearer and which can be electronically read by an electronic reader, such as a bar code scanner if the card 80 displays bar code data, and a photograph of the authorized wearer. The card 80 is disposed in the pocket 30 so that the data displayed by the card 80, on its anterior surface, are visible through the window 40. Moreover, the card 80 may display other data, such as a medical history of the authorized wearer, on its posterior surface. Advantageously, the card 80 is removable from the pocket 30, as for laundering of the pocket 30.

Along with or instead of the data described in the preceding paragraph, the card 80 may record, via a magnetic strip or a microchip or otherwise, data that identify the authorized wearer and that are readable via an electronic reader, such as an electronic scanner.

When the flap 50 covers the window 40, the flap 50 protects the data displayed on the anterior surface of the card 80 against becoming illegible because of foreign matter, such as soot, or because of surface abrasion. Optionally, for further protection thereagainst a separate, transparent, protective sheet is disposed in the pocket 30, so as to cover the anterior surface of the card 80. Optionally, for further protection thereagainst, the card 80 is made from cardboard but is laminated between two transparent, protective sheets.

As read by an electronic reader, the data displayed on the anterior surface of the card 80 may be used for perimeter security, by being compared to a database of authorized wearers, via a computer receiving the data from the electronic reader. Additionally, the same data may be used for any similar or dissimilar purpose disclosed in U.S. Pat. No. 5,596,652 and No. 6,029,889, supra.

The intention of claimed is:

1. A protective helmet, which is intended to be only worn by a wearer who is authorized to pass through a security perimeter, the protective helmet comprising an outer shell, a pocket, which is mounted exteriorly to the outer shell and which defines a window, a card, which is disposed in the pocket, the card displaying or recording data, which are readable through the window by a human, by an electronic reader, or by both, while the protective helmet is being worn by a wearer, and means for covering and uncovering the entire window so as to protect the data, when the entire window is covered, against becoming unreadable because of foreign matter, such as soot, or because of surface abrasion, the pocket being the sole pocket containing a card displaying or recording such data.

2. The protective helmet of claim 1, wherein the protecting means comprises a flap, which is movable between a position wherein the flap covers the entire window and positions wherein the flap does not cover the window, whereby, when the flap does not cover the window, the data are readable through the window and, when the flap covers the entire window, the flap protects the data against becoming unreadable because of foreign matter, such as soot, or because of surface abrasion.

3. The protective helmet of claim 2 further comprising means for attaching the flap detachably in the position wherein the flap covers the entire window.

4. The protective helmet of claim 3, wherein the attaching means comprises a hook-and-loop fastener.

5. The protective helmet of claim 1, 2, 3, or 4, wherein said data comprise symbolic data identifying the authorized wearer of the protective garment.

6. The protective helmet of claim 1, 2, 3, or 4, wherein said data comprise bar code data identifying the authorized wearer of the protective garment.

7. The protective helmet of claim 1, 2, 3, or 4, wherein said data comprise a photograph of the authorized wearer of the protective garment.

* * * * *